US007619370B2

(12) United States Patent
Chemel et al.

(10) Patent No.: US 7,619,370 B2
(45) Date of Patent: Nov. 17, 2009

(54) POWER ALLOCATION METHODS FOR LIGHTING DEVICES HAVING MULTIPLE SOURCE SPECTRUMS, AND APPARATUS EMPLOYING SAME

(75) Inventors: Brian Chemel, Marblehead, MA (US); Frederick M. Morgan, Quincy, MA (US)

(73) Assignee: Philips Solid-State Lighting Solutions, Inc., Burlington, MA (US)

( * ) Notice: Subject to any disclaimer, the term of this patent is extended or adjusted under 35 U.S.C. 154(b) by 733 days.

(21) Appl. No.: 11/325,080

(22) Filed: Jan. 3, 2006

(65) Prior Publication Data

US 2007/0152797 A1 Jul. 5, 2007

(51) Int. Cl.
*G05F 1/00* (2006.01)

(52) U.S. Cl. ..... 315/291; 315/312

(58) Field of Classification Search ..... 362/231, 362/594; 315/312, 291; 250/828, 282
See application file for complete search history.

(56) References Cited

U.S. PATENT DOCUMENTS 6,016,038 A 1/2000 Mueller et al.
6,150,774 A 11/2000 Mueller et al.
6,166,496 A 12/2000 Lys et al.
6,211,626 B1 4/2001 Lys et al.
6,292,901 B1 9/2001 Lys et al.
6,340,868 B1 1/2002 Lys et al.
6,459,919 B1 10/2002 Lys et al.
6,528,954 B1 3/2003 Lys et al.
6,548,967 B1 4/2003 Dowling et al.
6,577,080 B2 6/2003 Lys et al.
6,608,453 B2 * 8/2003 Morgan et al. ..... 315/312
6,624,597 B2 9/2003 Dowling et al.
6,717,376 B2 4/2004 Lys et al.
6,720,745 B2 4/2004 Mueller et al.
6,774,584 B2 8/2004 Lys et al.
6,777,891 B2 * 8/2004 Lys et al. ..... 315/291
6,781,329 B2 8/2004 Morgan et al.
6,788,011 B2 9/2004 Mueller et al.
6,801,003 B2 10/2004 Schanberger et al.
6,806,659 B1 10/2004 Mueller et al.
6,869,204 B2 3/2005 Morgan et al.
6,883,929 B2 4/2005 Dowling
6,888,322 B2 5/2005 Dowling et al.
6,897,624 B2 5/2005 Ducharme et al.
6,936,978 B2 8/2005 Morgan et al.

(Continued)

FOREIGN PATENT DOCUMENTS

EP 1152642 A 11/2001

*Primary Examiner*—Kidest Bahta

(57) ABSTRACT

Methods for allocating power amongst different source spectrums, or "channels," of a multi-channel lighting unit, and apparatus that employ such methods. Power allocation methods exploit the total light-generating capability of a lighting unit while maintaining safe operating power conditions, so as to avoid damage to the lighting unit due to excessive thermal power generation. In one example, a power allocation method ensures that a lighting unit operates at or near its maximum power handling capability for a variety of possible high brightness lighting conditions by ascribing a maximum per channel operating power equal to the maximum power handling capability of the lighting unit. The power allocation method then reapportions, if necessary, prescribed operating powers for multiple channels, in response to a given lighting command, such that the ratio of the prescribed powers remains the same but the sum of the channel operating powers does not exceed the maximum power handling capability of the lighting unit.

27 Claims, 5 Drawing Sheets

U.S. PATENT DOCUMENTS 6,965,205 B2 11/2005 Piepgras et al.
6,967,448 B2 11/2005 Morgan et al.
6,969,954 B2 11/2005 Lys
6,975,079 B2 12/2005 Lys et al.
2002/0038157 A1 3/2002 Dowling et al.
2002/0044066 A1 4/2002 Dowling et al.
2002/0048169 A1 4/2002 Dowling et al.
2002/0070688 A1 6/2002 Dowling et al.
2002/0074559 A1 6/2002 Dowling et al.
2002/0078221 A1 6/2002 Blackwell et al.
2002/0130627 A1 9/2002 Dowling et al.
2002/0145394 A1 10/2002 Morgan et al.
2002/0145869 A1 10/2002 Dowling
2002/0152045 A1 10/2002 Dowling et al.
2002/0158583 A1 10/2002 Lys et al.
2002/0176259 A1 11/2002 Ducharme
2003/0011538 A1 1/2003 Lys et al.
2003/0028260 A1 2/2003 Blackwell
2003/0057884 A1 3/2003 Dowling et al.
2003/0057887 A1 3/2003 Dowling et al.
2003/0076281 A1 4/2003 Morgan et al.
2003/0100837 A1 5/2003 Lys et al.
2003/0133292 A1 7/2003 Mueller et al.
2003/0222587 A1 12/2003 Dowling et al.
2004/0036006 A1 2/2004 Dowling
2004/0052076 A1 3/2004 Mueller et al.
2004/0090191 A1 5/2004 Mueller et al.
2004/0090787 A1 5/2004 Dowling et al.
2004/0105261 A1 6/2004 Ducharme et al.
2004/0113568 A1 6/2004 Dowling et al.
2004/0116039 A1 6/2004 Mueller et al.
2004/0130909 A1 7/2004 Mueller et al.
2004/0135522 A1 7/2004 Berman et al.
2004/0178751 A1 9/2004 Mueller et al.
2004/0212320 A1 10/2004 Dowling et al.
2004/0212321 A1 10/2004 Lys et al.
2004/0212993 A1 10/2004 Morgan et al.
2005/0099824 A1 5/2005 Dowling et al.
2005/0116665 A1* 6/2005 Colby et al. ..... 315/291
2005/0116667 A1* 6/2005 Mueller et al. ..... 315/312
2005/0151489 A1 7/2005 Lys et al.
2005/0213352 A1 9/2005 Lys et al.
2005/0213353 A1 9/2005 Lys
2005/0218838 A1 10/2005 Lys
2005/0218870 A1 10/2005 Lys
2005/0219872 A1 10/2005 Lys
2005/0231133 A1 10/2005 Lys
2005/0236029 A1 10/2005 Dowling
2005/0236998 A1 10/2005 Mueller
2005/0253533 A1 11/2005 Lys et al.
2005/0275626 A1* 12/2005 Mueller et al. ..... 345/156
2005/0276053 A1 12/2005 Nortrup
2006/0002110 A1 1/2006 Dowling
2006/0022214 A1* 2/2006 Morgan et al. ..... 257/99
2007/0189026 A1* 8/2007 Chemel et al. ..... 362/458

* cited by examiner

POWER ALLOCATION METHODS FOR LIGHTING DEVICES HAVING MULTIPLE SOURCE SPECTRUMS, AND APPARATUS EMPLOYING SAME

FIELD OF THE DISCLOSURE

The present disclosure relates generally to lighting devices that are configured to generate light based on additive mixing of multiple source spectrums. More particularly, the present disclosure is directed to methods for allocating power amongst different source spectrums of such a lighting device.

BACKGROUND

To create multi-colored or white light based on additive color mixing principles, often multiple different sources of colored light are employed, for example red light, blue light and green light, corresponding to the "primary" colors of human vision. These three primary colors roughly represent the respective spectral sensitivities typical of the three different types of cone receptors in the human eye (having peak sensitivities at wavelengths of approximately 650 nanometers for red, 530 nanometers for green, and 425 nanometers for blue) under photopic (i.e., daytime, or relatively bright) viewing conditions. Much research has shown that additive mixtures of primary colors in different proportions can create a wide range of colors discernible to humans.

Accordingly, based on additive mixing principles, a lighting device (hereinafter referred to as a lighting fixture or lighting unit) may be configured to generate variable color light or variable color temperature white light by employing multiple different source spectrums. In particular, a resulting spectrum of perceived light provided by the lighting unit is determined primarily by the relative amounts of radiant output power associated with the respective different source spectrums that are added together (for purposes of the present disclosure, each different source spectrum of such a lighting unit also may be referred to as a "channel," and the lighting unit may be referred to as a "multi-channel" lighting unit).

For example, consider a multi-channel lighting unit comprising a red channel, a green channel, and a blue channel (an R-G-B lighting unit), wherein each of a red channel contribution, a green channel contribution, and a blue channel contribution to the resulting spectrum may be specified (e.g., by some instruction or "lighting command") in terms of a percentage of the total available operating power for the channel (i.e., 0-100% for each channel). The total available operating power for a given channel may in turn be determined, for example, by the maximum voltage applied to, and the maximum average current drawn by, one or more light sources configured to generate the particular spectrum associated with the channel.

Hence, a lighting command of the format [R, G, B]=[100%, 100%, 100%] would cause the exemplary R-G-B lighting unit to generate maximum radiant output power for each of red, green and blue channels, thereby creating white light (as well as generating a maximum thermal power associated with operation of the light sources). More generally, a command calling for 100% of available operating power for each channel would correspond to a maximum total power consumption by the lighting unit, some of which is converted to radiant output power and some of which is converted to thermal power dissipated by the lighting unit. A command of the format [R, G, B]32 [50%, 50%, 50%] also would generate light perceived as white, but less bright than the light generated in response to the former command (and with less thermal power generation, and less overall power consumption).

A command of the format [R, G, B]=[100%, 0, 100%] would cause the lighting unit to generate maximum radiant output power for each of the red and blue channels, but no green output, thereby creating relatively bright purple light. Accordingly, it may be appreciated that a lighting command representing a prescribed percentage of available operating power for each channel of a multi-channel lighting unit essentially determines both the perceived color and brightness of the light generated by the lighting unit, as well as the thermal power generated by the lighting unit.

In various implementations, each different source spectrum in such a lighting unit may be generated by one light source or multiple light sources configured to generate substantially the same spectrum of light; in this manner, a lighting unit may include multiple light sources arranged in groups according to spectrum, wherein same-spectrum light sources are energized together (i.e., controlled as a group) in response to lighting commands. Additionally, the different-spectrum sources of a lighting unit may be configured to generate relatively narrow-band spectrums of radiation (e.g., essentially monochromatic sources corresponding approximately to the primary R-G-B colors of human vision), or relatively broad-band spectrums of radiation; hence, such lighting units may include narrow-band sources, broad-band sources, or a combination of various bandwidth and peak wavelength sources.

To determine a maximum operating power for each channel of a multi-channel lighting unit, an overall power handling capability of the lighting unit often is considered. In general, a maximum power handling capability of a lighting unit relates primarily to a heat dissipation capability of the lighting unit, or a maximum thermal power capacity which is not to be exceeded during operation (typically determined by an overall structure or housing configuration for the lighting unit). The maximum power handling capability of a given lighting unit typically is expressed in terms of a maximum total operating power (i.e., power consumption) in Watts (again, some of which represents the radiant output power of the generated light, and some of which represents thermal power associated with operation of the light sources). In designing multi-channel lighting units, it is often customary to divide the maximum power handling capability of the lighting unit by the number of channels in the lighting unit to arrive at a maximum power per channel. In this manner, if a desired light output requires a maximum contribution (i.e., 100%) from each of the different channels, damage to the lighting unit due to excessive thermal power generation may be avoided.

To illustrate this concept, consider a relatively straightforward example in which a maximum power handling capability of a lighting unit is given as 100 Watts, and that the lighting unit includes two different source spectrums or channels. In this example, the maximum operating power for each channel conventionally would be specified as 50 Watts (i.e., 100 Watts divided by two channels). Accordingly, if a lighting command has the format [$C_1$, $C_2$], wherein $C_1$ and $C_2$ represent the respective prescribed first and second channel percent operating powers, the lighting command [$C_1$, $C_2$]=[100%, 100%] would correspond to an operating power of 50 Watts for each of the first and second channels. Table 1 further illustrates this concept below for a number of different lighting commands [$C_1$, $C_2$] based on this example:

TABLE 1

| $C_1$ command | $C_2$ command | $C_1$ Operating Power | $C_2$ Operating Power | Total Operating Power |
|---|---|---|---|---|
| 100% | 0% | 50 W | 0 W | 50 W |
| 100% | 50% | 50 W | 25 W | 75 W |
| 100% | 100% | 50 W | 50 W | 100 W |
| 50% | 100% | 25 W | 50 W | 75 W |
| 0% | 100% | 0 W | 50 W | 50 W |
| 50% | 50% | 25 W | 25 W | 50 W |
| 25% | 25% | 12.5 W | 12.5 W | 25 W |

A generalized formula for a prescribed operating power $P_x$ of a given channel in response to an arbitrary channel command $C_x$ from 0 to 100%, based on the power allocation methodology represented by the example of Table 1 above, may be given as $$P_x = C_x\left(\frac{P_{max}}{N}\right), \tag{1}$$

where $P_{max}$ denotes the maximum power handling capability of the lighting unit, and N is the number of different channels in the lighting unit. As mentioned above, the prescribed operating power $P_x$ of a given channel in turn dictates the voltage applied to, and the average current permitted to be drawn by, one or more light sources configured to generate the particular spectrum corresponding to the channel. Hence, in response to an arbitrary channel command $C_x$, a particular voltage and current is applied to the light source of the channel such that the prescribed operating power $P_x$ is consumed, and a corresponding radiant output power of light is generated for the channel.

SUMMARY

Applicants have recognized and appreciated that while the above-discussed technique for dividing power in a multi-channel lighting unit effectively mitigates damage to a lighting unit due to excessive operating power (i.e., excessive thermal power generation), it nonetheless sacrifices some of the light-generating capability of the lighting unit. In particular, this problem is exacerbated for situations in which, to generate a desired color and brightness of light from the lighting unit, a prescribed percent operating power for one channel is significantly higher than that of another channel. For example, consider the first row of Table 1 above; the lighting command is specifying a full operating power for the first channel and no output for the second channel to generate a desired color and brightness of light; however, the total operating power of the lighting unit in response to this command represents only half of the maximum power handling capability of the lighting unit (i.e., half of the total light-generating capability of the lighting unit).

In view of the foregoing, the present disclosure is directed generally to improved power allocation methods that exploit the total light-generating capability of a lighting unit while at the same time maintaining safe operating power conditions, so as to avoid damage due to excessive thermal power generation. In one exemplary embodiment, a power allocation method ensures that a lighting unit operates at or near its maximum power handling capability for a variety of possible high brightness lighting conditions by ascribing a maximum per channel operating power equal to the maximum power handling capability of the lighting unit. The power allocation method then reapportions, if necessary, prescribed operating powers for multiple channels, in response to a given lighting command, such that the ratio of the prescribed powers remains the same but the sum of the channel operating powers does not exceed the maximum power handling capability of the lighting unit.

Thus, one embodiment of the present disclosure is directed to an apparatus, comprising at least one first light source to generate first radiation having a first spectrum, at least one second light source to generate second radiation having a second spectrum different from the first spectrum, and at least one structure coupled to the at least one first light source and the at least one second light source, the at least one structure having a maximum power handling capability. The apparatus further comprises at least one controller configured to allocate a first operating power for the at least one first light source and a second operating power for the at least one second light source so as to optimize the first and second operating powers without exceeding the maximum power handling capability.

Another embodiment is directed to a method performed in an apparatus comprising at least one first light source to generate first radiation having a first spectrum, at least one second light source to generate second radiation having a second spectrum different from the first spectrum, and at least one structure coupled to the at least one first light source and the at least one second light source, wherein the at least one structure has a maximum power handling capability. The method comprises an act of allocating a first operating power for the at least one first light source and a second operating power for the at least one second light source so as to optimize the first and second operating powers without exceeding the maximum power handling capability.

Another embodiment is directed to a method performed in an apparatus comprising at least one first light source to generate first radiation having a first spectrum, at least one second light source to generate second radiation having a second spectrum different from the first spectrum, and at least one structure coupled to the at least one first light source and the at least one second light source, wherein the at least one structure has a maximum power handling capability. The method comprises acts of A) setting the maximum available operating power for each of the at least one first light source and the at least one second light source equal to the maximum power handling capability; B) receiving at least one lighting command including at least a first channel command representing a prescribed first operating power for the at least one first light source and a second channel command representing a prescribed second operating power for the at least one second light source; C) determining one of at least the first channel command and the second channel command having a maximum value; D) multiplying each of at least the first channel command and the second channel command by the maximum value; and E) dividing each of at least the first channel command and the second channel command by a sum of at least the first channel command and the second channel command, so as to optimize the first and second operating powers without exceeding the maximum power handling capability.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, electroluminescent strips, and the like.

In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "spectrum" should be understood to refer to any one or more frequencies (or wavelengths) of radiation produced by one or more light sources. Accordingly, the term "spectrum" refers to frequencies (or wavelengths) not only in the visible range, but also frequencies (or wavelengths) in the infrared, ultraviolet, and other areas of the overall electromagnetic spectrum. Also, a given spectrum may have a relatively narrow bandwidth (e.g., a FWHM having essentially few frequency or wavelength components) or a relatively wide bandwidth (several frequency or wavelength components having various relative strengths). It should also be appreciated that a given spectrum may be the result of a mixing of two or more other spectra (e.g., mixing radiation respectively emitted from multiple light sources).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700 degrees K (typically considered the first visible to the human eye) to over 10,000 degrees K; white light generally is perceived at color temperatures above 1500-2000 degrees K.

Lower color temperatures generally indicate white light having a more significant red component or a "warmer feel," while higher color temperatures generally indicate white light having a more significant blue component or a "cooler feel." By way of example, fire has a color temperature of approximately 1,800 degrees K, a conventional incandescent bulb has a color temperature of approximately 2848 degrees K, early morning daylight has a color temperature of approximately 3,000 degrees K, and overcast midday skies have a color temperature of approximately 10,000 degrees K. A color image viewed under white light having a color temperature of approximately 3,000 degree K has a relatively reddish tone, whereas the same color image viewed under white light having a color temperature of approximately 10,000 degrees K has a relatively bluish tone.

The terms "lighting unit" and "lighting fixture" are used interchangeably herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "addressable" is used herein to refer to a device (e.g., a light source in general, a lighting unit or fixture, a controller or processor associated with one or more light sources or lighting units, other non-lighting related devices, etc.) that is configured to receive information (e.g., data) intended for multiple devices, including itself, and to selectively respond to particular information intended for it. The term "addressable" often is used in connection with a networked environment (or a "network," discussed further below), in which multiple devices are coupled together via some communications medium or media.

In one network implementation, one or more devices coupled to a network may serve as a controller for one or more other devices coupled to the network (e.g., in a master/slave relationship). In another implementation, a networked environment may include one or more dedicated controllers that are configured to control one or more of the devices coupled to the network. Generally, multiple devices coupled to the network each may have access to data that is present on the communications medium or media; however, a given device may be "addressable" in that it is configured to selectively exchange data with (i.e., receive data from and/or transmit data to) the network, based, for example, on one or more particular identifiers (e.g., "addresses") assigned to it.

The term "network" as used herein refers to any interconnection of two or more, devices (including controllers or processors) that facilitates the transport of information (e.g. for device control, data storage, data exchange, etc.) between any two or more devices and/or among multiple devices coupled to the network. As should be readily appreciated, various implementations of networks suitable for interconnecting multiple devices may include any of a variety of network topologies and employ any of a variety of communication protocols. Additionally, in various networks according to the present disclosure, any one connection between two devices may represent a dedicated connection between the two systems, or alternatively a non-dedicated connection. In addition to carrying information intended for the two devices, such a non-dedicated connection may carry information not necessarily intended for either of the two devices (e.g., an open network connection). Furthermore, it should be readily appreciated that various networks of devices as discussed herein may employ one or more wireless, wire/cable, and/or fiber optic links to facilitate information transport throughout the network.

The term "user interface" as used herein refers to an interface between a human user or operator and one or more devices that enables communication between the user and the device(s). Examples of user interfaces that may be employed in various implementations of the present disclosure include, but are not limited to, switches, potentiometers, buttons, dials, sliders, a mouse, keyboard, keypad, various types of game controllers (e.g., joysticks), track balls, display screens, various types of graphical user interfaces (GUIs), touch screens, microphones and other types of sensors that may receive some form of human-generated stimulus and generate a signal in response thereto.

The following patents and patent applications are hereby incorporated herein by reference:

U.S. Pat. No. 6,016,038, issued Jan. 18, 2000, entitled "Multicolored LED Lighting Method and Apparatus;"

U.S. Pat. No. 6,211,626, issued Apr. 3, 2001 to Lys et al, entitled "Illumination Components,"

U.S. Pat. No. 6,608,453, issued Aug. 19, 2003, entitled "Methods and Apparatus for Controlling Devices in a Networked Lighting System;"

U.S. Pat. No. 6,548,967, issued Apr. 15, 2003, entitled "Universal Lighting Network Methods and Systems;"

U.S. Pat. No. 6,717,376, issued Apr. 6, 2004, entitled "Methods and Apparatus for Controlling Devices in a Networked Lighting System;"

U.S. Pat. No. 6,965,205, issued Nov. 15, 2005, entitled "Light Emitting Diode Based Products;"

U.S. Pat. No. 6,967,448, issued Nov. 22, 2005, entitled "Methods and Apparatus for Controlling Illumination;"

U.S. Pat. No. 6,975,079, issued Dec. 13, 2005, entitled "Systems and Methods for Controlling Illumination Sources;"

U.S. patent application Ser. No. 09/886,958, filed Jun. 21, 2001, entitled Method and Apparatus for Controlling a Lighting System in Response to an Audio Input;"

U.S. patent application Ser. No. 10/078,221, filed Feb. 19, 2002, entitled "Systems and Methods for Programming Illumination Devices;"

U.S. patent application Ser. No. 09/344,699, filed Jun. 25, 1999, entitled "Method for Software Driven Generation of Multiple Simultaneous High Speed Pulse Width Modulated Signals;"

U.S. patent application Ser. No. 09/805,368, filed Mar. 13, 2001, entitled "Light-Emitting Diode Based Products;"

U.S. patent application Ser. No. 09/716,819, filed Nov. 20, 2000, entitled "Systems and Methods for Generating and Modulating Illumination Conditions;"

U.S. patent application Ser. No. 09/675,419, filed Sep. 29, 2000, entitled "Systems and Methods for Calibrating Light Output by Light-Emitting Diodes;"

U.S. patent application Ser. No. 09/870,418, filed May 30, 2001, entitled "A Method and Apparatus for Authoring and Playing Back Lighting Sequences;"

U.S. patent application Ser. No. 10/045,604, filed Mar. 27, 2003, entitled "Systems and Methods for Digital Entertainment;"

U.S. patent application Ser. No. 09/989,677, filed Nov. 20, 2001, entitled "Information Systems;"

U.S. patent application Ser. No. 10/163,085, filed Jun. 5, 2002, entitled "Systems and Methods for Controlling Programmable Lighting Systems;"

U.S. patent application Ser. No. 10/245,788, filed Sep. 17, 2002, entitled "Methods and Apparatus for Generating and Modulating White Light Illumination Conditions;"

U.S. patent application Ser. No. 10/325,635, filed Dec. 19, 2002, entitled "Controlled Lighting Methods and Apparatus;"

U.S. patent application Ser. No. 10/360,594, filed Feb. 6, 2003, entitled "Controlled Lighting Methods and Apparatus;"

U.S. patent application Ser. No. 10/435,687, filed May 9, 2003, entitled "Methods and Apparatus for Providing Power to Lighting Devices;"

U.S. patent application Ser. No. 10/828,933, filed Apr. 21, 2004, entitled "Tile Lighting Methods and Systems;"

U.S. patent application Ser. No. 10/839,765, filed May 5, 2004, entitled "Lighting Methods and Systems;"

U.S. patent application Ser. No. 11/010,840, filed Dec. 13, 2004, entitled "Thermal Management Methods and Apparatus for Lighting Devices;"

U.S. patent application Ser. No. 11/079,904, filed Mar. 14, 2005, entitled "LED Power Control Methods and Apparatus;"

U.S. patent application Ser. No. 11/081,020, filed on Mar. 15, 2005, entitled "Methods and Systems for Providing Lighting Systems;"

U.S. patent application Ser. No. 11/178,214, filed Jul. 8, 2005, entitled "LED Package Methods and Systems;"

U.S. patent application Ser. No. 11/225,377, filed Sep. 12, 2005, entitled "Power Control Methods and Apparatus for Variable Loads;" and U.S. patent application Ser. No. 11/224,683, filed Sep. 12, 2005, entitled "Lighting Zone Control Methods and Systems."

It should be appreciated that all combinations of the foregoing concepts and additional concepts discussed in greater detail below are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

DETAILED DESCRIPTION

Various embodiments of the present disclosure are described below, including certain embodiments relating particularly to LED-based light sources. It should be appreciated, however, that the present disclosure is not limited to any particular manner of implementation, and that the various embodiments discussed explicitly herein are primarily for purposes of illustration. For example, the various concepts discussed herein may be suitably implemented in a variety of environments involving LED-based light sources, other types of light sources not including LEDs, environments that involve both LEDs and other types of light sources in combination, and environments that involve non-lighting-related devices alone or in combination with various types of light sources.

The present disclosure relates generally to improved methods for allocating power amongst different source spectrums, or "channels," of a multi-channel lighting unit, and apparatus that employ such methods. In general, power allocation methods according to the present disclosure exploit the total light-generating capability of a lighting unit while maintaining safe operating power conditions, so as to avoid damage to the lighting unit due to excessive thermal power generation.

Figure 1:
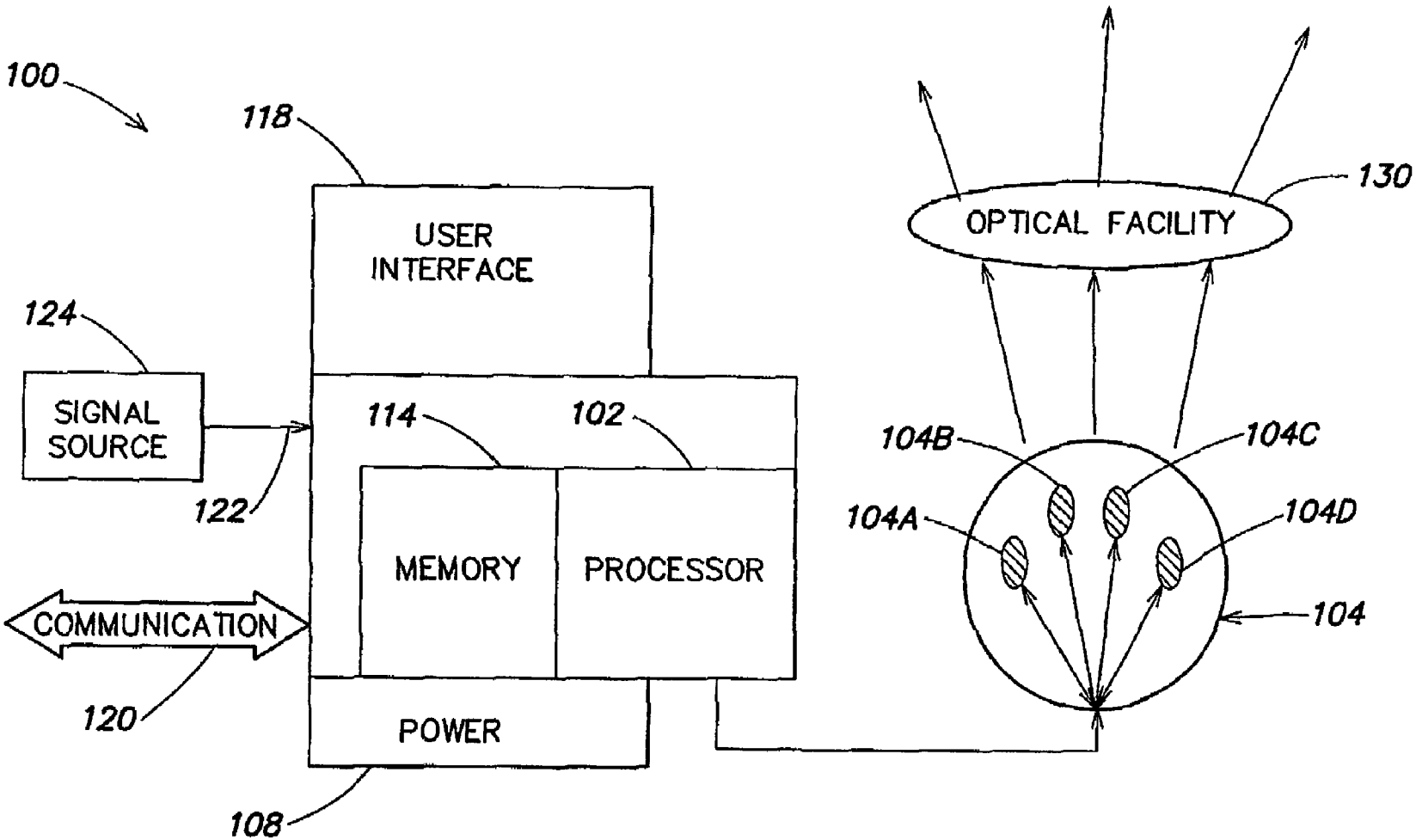
FIG. 1 is a diagram illustrating a lighting unit according to one embodiment of the disclosure.

FIG. 1 illustrates one example of a lighting unit 100 that may be configured to implement power allocation methods according to various embodiments of the present disclosure. Some general examples of LED-based lighting units similar to those that are described below in connection with FIG. 1 may be found, for example, in U.S. Pat. No. 6,016,038, issued Jan. 18, 2000 to Mueller et al., entitled "Multicolored LED Lighting Method and Apparatus," and U.S. Pat. No. 6,211,626, issued Apr. 3, 2001 to Lys et al, entitled "Illumination Components," which patents are both hereby incorporated herein by reference.

In various embodiments of the present disclosure, the lighting unit 100 shown in FIG. 1 may be used alone or together with other similar lighting units in a system of lighting units (e.g., as discussed further below in connection with FIG. 2). Used alone or in combination with other lighting units, the lighting unit 100 may be employed in a variety of applications including, but not limited to, interior or exterior space (e.g., architectural) illumination in general, direct or indirect illumination of objects or spaces, theatrical or other entertainment-based/special effects lighting, decorative lighting, safety-oriented lighting, vehicular lighting, illumination of displays and/or merchandise (e.g. for advertising and/or in retail/consumer environments), combined illumination and communication systems, etc., as well as for various indication, display and informational purposes.

Additionally, one or more lighting units similar to that described in connection with FIG. 1 may be implemented in a variety of products including, but not limited to, various forms of light modules or bulbs having various shapes and electrical/mechanical coupling arrangements (including replacement or "retrofit" modules or bulbs adapted for use in conventional sockets or fixtures), as well as a variety of consumer and/or household products (e.g., night lights, toys, games or game components, entertainment components or systems, utensils, appliances, kitchen aids, cleaning products, etc.) and architectural components (e.g., lighted panels for walls, floors, ceilings, lighted trim and ornamentation components, etc.).

In one embodiment, the lighting unit 100 shown in FIG. 1 may include one or more light sources 104A, 104B, 104C, and 104D (shown collectively as 104), wherein one or more of the light sources may be an LED-based light source that includes one or more light emitting diodes (LEDs). In one aspect of this embodiment, any two or more of the light sources may be adapted to generate radiation of different colors (e.g. red, green, blue); in this respect, as discussed above, each of the different color light sources generates a different source spectrum that constitutes a different "channel" of a "multi-channel" lighting unit. Although FIG. 1 shows four light sources 104A, 104B, 104C, and 104D, it should be appreciated that the lighting unit is not limited in this respect, as different numbers and various types of light sources (all LED-based light sources, LED-based and non-LED-based light sources in combination, etc.) adapted to generate radiation of a variety of different colors, including essentially white light, may be employed in the lighting unit 100, as discussed further below.

As shown in FIG. 1, the lighting unit 100 also may include a processor 102 that is configured to output one or more control signals to drive the light sources so as to generate various intensities of light from the light sources. For example, in one implementation, the processor 102 may be configured to output at least one control signal for each light source so as to independently control the intensity of light (e.g., radiant power in lumens) generated by each light source. Some examples of control signals that may be generated by the processor to control the light sources include, but are not limited to, pulse modulated signals, pulse width modulated signals (PWM), pulse amplitude modulated signals (PAM), pulse code modulated signals (PCM) analog control signals (e.g., current control signals, voltage control signals), combinations and/or modulations of the foregoing signals, or other control signals. In one aspect, particularly in connection with LED-based sources, one or more modulation techniques provide for variable control using a fixed current level applied to one or more LEDs, so as to mitigate potential undesirable or unpredictable variations in LED output that may arise if a variable LED drive current were employed. In another aspect, the processor 102 may control other dedicated circuitry (not shown in FIG. 1) which in turn controls the light sources so as to vary their respective intensities.

In general, the intensity (radiant output power) of radiation generated by the one or more light sources is proportional to the average power delivered to the light source(s) over a given time period. Accordingly, one technique for varying the intensity of radiation generated by the one or more light sources involves modulating the power delivered to (i.e., the operating power of) the light source(s). For some types of light sources, including LED-based sources, this may be accomplished effectively using a pulse width modulation (PWM) technique.

In one exemplary implementation of a PWM control technique, for each channel of a lighting unit a fixed predetermined voltage $V_{source}$ is applied periodically across a given light source constituting the channel. The application of the voltage $V_{source}$ may be accomplished via one or more switches, not shown in FIG. 1, controlled by the processor 102. While the voltage $V_{source}$ is applied across the light source, a predetermined maximum current $I_{source}$ (e.g., determined by a current regulator, also not shown in FIG. 1) is allowed to flow through the light source. Again, recall that an LED-based light source may include one or more LEDs, such that the voltage $V_{source}$ may be applied to a group of LEDs constituting the source, and the current $I_{source}$ may be drawn by the group of LEDs. The fixed voltage $V_{source}$ across the light source when energized, and the regulated current $I_{source}$ drawn by the light source when energized, determines the amount of instantaneous operating power $P_{source}$ of the light source ($P_{source}=V_{source}-I_{source}$). As mentioned above, for LED-based light sources, using a regulated current mitigates potential undesirable or unpredictable variations in LED output that may arise if a variable LED drive current were employed.

According to the PWM technique, by periodically applying the voltage $V_{source}$ to the light source and varying the time the voltage is applied during a given on-off cycle, the average power delivered to the light source over time (the average operating power) may be modulated. In particular, the processor 102 may be configured to apply the voltage $V_{source}$ to a given light source in a pulsed fashion (e.g., by outputting a control signal that operates one or more switches to apply the voltage to the light source), preferably at a frequency that is greater than that capable of being detected by the human eye (e.g., greater than approximately 100 Hz). In this manner, an observer of the light generated by the light source does not perceive the discrete on-off cycles (commonly referred to as a "flicker effect"), but instead the integrating function of the eye perceives essentially continuous light generation. By adjusting the pulse width (i.e. on-time, or "duty cycle") of on-off cycles of the control signal, the processor varies the average amount of time the light source is energized in any given time period, and hence varies the average operating power of the light source. In this manner, the perceived brightness of the generated light from each channel in turn may be varied.

As discussed in greater detail below, the processor 102 may be configured to control each different channel of a multi-channel lighting unit at a predetermined average operating power to provide a corresponding radiant output power for the light generated by each channel. Alternatively, the processor 102 may receive instructions (e.g., "lighting commands") from a variety of origins, such as a user interface 118, a signal source 124, or one or more communication ports 120, that specify prescribed operating powers for one or more channels and, hence, corresponding radiant output powers for the light generated by the respective channels. By varying the prescribed operating powers for one or more channels (e.g., pursuant to different instructions or lighting commands), different perceived colors and brightnesses of light may be generated by the lighting unit.

In one embodiment of the lighting unit 100, as mentioned above, one or more of the light sources 104A, 104B, 104C, and 104D shown in FIG. 1 may include a group of multiple LEDs or other types of light sources (e.g., various parallel and/or serial connections of LEDs or other types of light sources) that are controlled together by the processor 102. Additionally, it should be appreciated that one or more of the light sources may include one or more LEDs that are adapted to generate radiation having any of a variety of spectra (i.e., wavelengths or wavelength bands), including, but not limited to, various visible colors (including essentially white light), various color temperatures of white light, ultraviolet, or infrared. LEDs having a variety of spectral bandwidths (e.g., narrow band, broader band) may be employed in various implementations of the lighting unit 100.

In another aspect of the lighting unit 100 shown in FIG. 1, the lighting unit 100 may be constructed and arranged to produce a wide range of variable color radiation. For example, the lighting unit 100 may be particularly arranged such that the processor-controlled variable intensity (i.e., variable radiant power) light generated by two or more of the light sources combines to produce a mixed colored light (including essentially white light having a variety of color temperatures). In particular, the color (or color temperature) of the mixed colored light may be varied by varying one or more of the respective intensities (output radiant power) of the light sources (e.g., in response to one or more control signals output by the processor 102). Furthermore, the processor 102 may be particularly configured (e.g., programmed) to provide control signals to one or more of the light sources so as to generate a variety of static or time-varying (dynamic) multi-color (or multi-color temperature) lighting effects.

Thus, the lighting unit 100 may include a wide variety of colors of LEDs in various combinations, including two or more of red, green, and blue LEDs to produce a color mix, as well as one or more other LEDs to create varying colors and color temperatures of white light. For example, red, green and blue can be mixed with amber, white, UV, orange, IR or other colors of LEDs. Such combinations of differently colored LEDs in the lighting unit 100 can facilitate accurate reproduction of a host of desirable spectrums of lighting conditions, examples of which include, but are not limited to, a variety of outside daylight equivalents at different times of the day, various interior lighting conditions, lighting conditions to simulate a complex multicolored background, and the like. Other desirable lighting conditions can be created by removing particular pieces of spectrum that may be specifically absorbed, attenuated or reflected in certain environments. Water, for example tends to absorb and attenuate most non-blue and non-green colors of light, so underwater applications may benefit from lighting conditions that are tailored to emphasize or attenuate some spectral elements relative to others.

As shown in FIG. 1, the lighting unit 100 also may include a memory 114 to store various information. For example, the memory 114 may be employed to store one or more lighting commands or programs for execution by the processor 102 (e.g., to generate one or more control signals for the light sources), as well as various types of data useful for generating variable color radiation (e.g., calibration information, discussed further below). The memory 114 also may store one or more particular identifiers (e.g., a serial number, an address, etc.) that may be used either locally or on a system level to identify the lighting unit 100. In various embodiments, such identifiers may be pre-programmed by a manufacturer, for example, and may be either alterable or non-alterable thereafter (e.g., via some type of user interface located on the lighting unit, via one or more data or control signals received by the lighting unit, etc.). Alternatively, such identifiers may be determined at the time of initial use of the lighting unit in the field, and again may be alterable or non-alterable thereafter.

One issue that may arise in connection with controlling multiple light sources in the lighting unit 100 of FIG. 1, and controlling multiple lighting units 100 in a lighting system (e.g., as discussed below in connection with FIG. 2), relates to potentially perceptible differences in light output between substantially similar light sources. For example, given two virtually identical light sources being driven by respective identical control signals, the actual intensity of light (e.g., radiant power in lumens) output by each light source may be measurably different. Such a difference in light output may be attributed to various factors including, for example, slight manufacturing differences between the light sources, normal wear and tear over time of the light sources that may differently alter the respective spectrums of the generated radiation, etc. For purposes of the present discussion, light sources for which a particular relationship between a control signal and resulting output radiant power are not known are referred to as "uncalibrated" light sources.

The use of one or more uncalibrated light sources in the lighting unit 100 shown in FIG. 1 may result in generation of light having an unpredictable, or "uncalibrated," color or color temperature. For example, consider a first lighting unit including a first uncalibrated red light source and a first uncalibrated blue light source, each controlled in response to a corresponding lighting command having an adjustable parameter in a range of from zero to 255 (0-255), wherein the maximum value of 255 represents the maximum radiant power available (i.e., 100%) from the light source. For purposes of this example, if the red command is set to zero and the blue command is non-zero, blue light is generated, whereas if the blue command is set to zero and the red command is non-zero, red light is generated. However, if both commands are varied from non-zero values, a variety of perceptibly different colors may be produced (e.g., in this example, at very least, many different shades of purple are possible). In particular, perhaps a particular desired color (e.g., lavender) is given by a red command having a value of 125 and a blue command having a value of 200.

Now consider a second lighting unit including a second uncalibrated red light source substantially similar to the first uncalibrated red light source of the first lighting unit, and a second uncalibrated blue light source substantially similar to the first uncalibrated blue light source of the first lighting unit. As discussed above, even if both of the uncalibrated red light sources are controlled in response to respective identical commands, the actual intensity of light (e.g., radiant power in lumens) output by each red light source may be measurably different. Similarly, even if both of the uncalibrated blue light sources are controlled in response to respective identical commands, the actual light output by each blue light source may be measurably different.

With the foregoing in mind, it should be appreciated that if multiple uncalibrated light sources are used in combination in lighting units to produce a mixed colored light as discussed above, the observed color (or color temperature) of light produced by different lighting units under identical control conditions may be perceivably different. Specifically, consider again the "lavender" example above; the "first lavender" produced by the first lighting unit with a red command having a value of 125 and a blue command having a value of 200 indeed may be perceivably different than a "second lavender"

produced by the second lighting unit with a red command having a value of 125 and a blue command having a value of 200. More generally, the first and second lighting units generate uncalibrated colors by virtue of their uncalibrated light sources.

In view of the foregoing, in one embodiment of the present disclosure, the lighting unit 100 includes calibration means to facilitate the generation of light having a calibrated (e.g., predictable, reproducible) color at any given time. In one aspect, the calibration means is configured to adjust (e.g., scale) the light output of at least some light sources of the lighting unit so as to compensate for perceptible differences between similar light sources used in different lighting units.

For example, in one embodiment, the processor 102 of the lighting unit 100 is configured to control one or more of the light sources so as to output radiation at a calibrated intensity that substantially corresponds in a predetermined manner to a control signal for the light source(s). As a result of mixing radiation having different spectra and respective calibrated intensities, a calibrated color is produced. In one aspect of this embodiment, at least one calibration value for each light source is stored in the memory 114, and the processor is programmed to apply the respective calibration values to the control signals (commands) for the corresponding light sources so as to generate the calibrated intensities.

In one aspect of this embodiment, one or more calibration values may be determined once (e.g., during a lighting unit manufacturing/testing phase) and stored in the memory 114 for use by the processor 102. In another aspect, the processor 102 may be configured to derive one or more calibration values dynamically (e.g. from time to time) with the aid of one or more photosensors, for example. In various embodiments, the photosensor(s) may be one or more external components coupled to the lighting unit, or alternatively may be integrated as part of the lighting unit itself. A photosensor is one example of a signal source that may be integrated or otherwise associated with the lighting unit 100, and monitored by the processor 102 in connection with the operation of the lighting unit. Other examples of such signal sources are discussed further below, in connection with the signal source 124 shown in FIG. 1.

One exemplary method that may be implemented by the processor 102 to derive one or more calibration values includes applying a reference control signal to a light source (e.g., corresponding to maximum output radiant power), and measuring (e.g., via one or more photosensors) an intensity of radiation (e.g., radiant power falling on the photosensor) thus generated by the light source. The processor may be programmed to then make a comparison of the measured intensity and at least one reference value (e.g., representing an intensity that nominally would be expected in response to the reference control signal). Based on such a comparison, the processor may determine one or more calibration values (e.g., scaling factors) for the light source. In particular, the processor may derive a calibration value such that, when applied to the reference control signal, the light source outputs radiation having an intensity that corresponds to the reference value (i.e., an "expected" intensity, e.g., expected radiant power in lumens).

In various aspects, one calibration value may be derived for an entire range of control signal/output intensities for a given light source. Alternatively, multiple calibration values may be derived for a given light source (i.e., a number of calibration value "samples" may be obtained) that are respectively applied over different control signal/output intensity ranges, to approximate a nonlinear calibration function in a piecewise linear manner.

In another aspect, as also shown in FIG. 1, the lighting unit 100 optionally may include one or more user interfaces 118 that are provided to facilitate any of a number of user-selectable settings or functions (e.g., generally controlling the light output of the lighting unit 100, changing and/or selecting various pre-programmed lighting effects to be generated by the lighting unit, changing and/or selecting various parameters of selected lighting effects, setting particular identifiers such as addresses or serial numbers for the lighting unit, etc.). In various embodiments, the communication between the user interface 118 and the lighting unit may be accomplished through wire or cable, or wireless transmission.

In one implementation, the processor 102 of the lighting unit monitors the user interface 118 and controls one or more of the light sources 104A, 104B, 104C and 104D based at least in part on a user's operation of the interface. For example, the processor 102 may be configured to respond to operation of the user interface by originating one or more control signals for controlling one or more of the light sources. Alternatively, the processor 102 may be configured to respond by selecting one or more pre-programmed control signals stored in memory, modifying control signals generated by executing a lighting program, selecting and executing a new lighting program from memory, or otherwise affecting the radiation generated by one or more of the light sources.

In particular, in one implementation, the user interface 118 may constitute one or more switches (e.g., a standard wall switch) that interrupt power to the processor 102. In one aspect of this implementation, the processor 102 is configured to monitor the power as controlled by the user interface, and in turn control one or more of the light sources based at least in part on a duration of a power interruption caused by operation of the user interface. As discussed above, the processor may be particularly configured to respond to a predetermined duration of a power interruption by, for example, selecting one or more pre-programmed control signals stored in memory, modifying control signals generated by executing a lighting program, selecting and executing a new lighting program from memory, or otherwise affecting the radiation generated by one or more of the light sources.

FIG. 1 also illustrates that the lighting unit 100 may be configured to receive one or more signals 122 from one or more other signal sources 124. In one implementation, the processor 102 of the lighting unit may use the signal(s) 122, either alone or in combination with other control signals (e.g., signals generated by executing a lighting program, one or more outputs from a user interface, etc.), so as to control one or more of the light sources 104A, 104B and 104C in a manner similar to that discussed above in connection with the user interface.

Examples of the signal(s) 122 that may be received and processed by the processor 102 include, but are not limited to, one or more audio signals, video signals, power signals, various types of data signals, signals representing information obtained from a network (e.g., the Internet), signals representing one or more detectable/sensed conditions, signals from lighting units, signals consisting of modulated light, etc. In various implementations, the signal source(s) 124 may be located remotely from the lighting unit 100, or included as a component of the lighting unit. For example, in one embodiment, a signal from one lighting unit 100 could be sent over a network to another lighting unit 100.

Some examples of a signal source 124 that may be employed in, or used in connection with, the lighting unit 100 of FIG. 1 include any of a variety of sensors or transducers that generate one or more signals 122 in response to some stimulus. Examples of such sensors include, but are not limited to, various types of environmental condition sensors, such as thermally sensitive (e.g., temperature, infrared) sensors, humidity sensors, motion sensors, photosensors/light sensors (e.g., photodiodes, sensors that are sensitive to one or more particular spectra of electromagnetic radiation such as spectroradiometers or spectrophotometers, etc.), various types of cameras, sound or vibration sensors or other pressure/force transducers (e.g., microphones, piezoelectric devices), and the like.

Additional examples of a signal source 124 include various metering/detection devices that monitor electrical signals or characteristics (e.g., voltage, current, power, resistance, capacitance, inductance, etc.) or chemical/biological characteristics (e.g., acidity, a presence of one or more particular chemical or biological agents, bacteria, etc.) and provide one or more signals 122 based on measured values of the signals or characteristics. Yet other examples of a signal source 124 include various types of scanners, image recognition systems, voice or other sound recognition systems, artificial intelligence and robotics systems, and the like. A signal source 124 could also be a lighting unit 100, a processor 102, or any one of many available signal generating devices, such as media players, MP3 players, computers, DVD players, CD players, television signal sources, camera signal sources, microphones, speakers, telephones, cellular phones, instant messenger devices, SMS devices, wireless devices, personal organizer devices, and many others.

In one embodiment, the lighting unit 100 shown in FIG. 1 also may include one or more optical elements 130 to optically process the radiation generated by the light sources 104A, 104B, and 104C. For example, one or more optical elements may be configured so as to change one or both of a spatial distribution and a propagation direction of the generated radiation. In particular, one or more optical elements may be configured to change a diffusion angle of the generated radiation. In one aspect of this embodiment, one or more optical elements 130 may be particularly configured to variably change one or both of a spatial distribution and a propagation direction of the generated radiation (e.g., in response to some electrical and/or mechanical stimulus). Examples of optical elements that may be included in the lighting unit 100 include, but are not limited to, reflective materials, refractive materials, translucent materials, filters, lenses, mirrors, and fiber optics. The optical element 130 also may include a phosphorescent material, luminescent material, or other material capable of responding to or interacting with the generated radiation.

As also shown in FIG. 1, the lighting unit 100 may include one or more communication ports 120 to facilitate coupling of the lighting unit 100 to any of a variety of other devices. For example, one or more communication ports 120 may facilitate coupling multiple lighting units together as a networked lighting system, in which at least some of the lighting units are addressable (e.g., have particular identifiers or addresses) and are responsive to particular data transported across the network.

In particular, in a networked lighting system environment, as discussed in greater detail further below (e.g., in connection with FIG. 2), as data is communicated via the network, the processor 102 of each lighting unit coupled to the network may be configured to be responsive to particular data (e.g., lighting control commands) that pertain to it (e.g., in some cases, as dictated by the respective identifiers of the networked lighting units). Once a given processor identifies particular data intended for it, it may read the data and, for example, change the lighting conditions produced by its light sources according to the received data (e.g., by generating appropriate control signals to the light sources). In one aspect, the memory 114 of each lighting unit coupled to the network may be loaded, for example, with a table of lighting control signals that correspond with data the processor 102 receives. Once the processor 102 receives data from the network, the processor may consult the table to select the control signals that correspond to the received data, and control the light sources of the lighting unit accordingly.

In one aspect of this embodiment, the processor 102 of a given lighting unit, whether or not coupled to a network, may be configured to interpret lighting instructions/data that are received in a DMX protocol (as discussed, for example, in U.S. Pat. No. 6,016,038 and U.S. Pat. No. 6,211,626), which is a lighting command protocol conventionally employed in the lighting industry for some programmable lighting applications. For example, in one aspect, a lighting command in DMX protocol may specify each of a red channel command, a green channel command, and a blue channel command as eight-bit data (i.e., a data byte) representing a value from 0 to 255, wherein the maximum value of 255 for any one of the color channels instructs the processor 102 to control the corresponding light source(s) to operate at maximum available power (i.e., 100%) for the channel, thereby generating the maximum available radiant power for that color (such a command structure for an R-G-B lighting unit commonly is referred to as 24-bit color control). Hence, a command of the format [R, G, B]=[255, 255, 255] would cause the lighting unit to generate maximum radiant power for each of red, green and blue light (thereby creating white light).

It should be appreciated, however, that lighting units suitable for purposes of the present disclosure are not limited to a DMX command format, as lighting units according to various embodiments may be configured to be responsive to other types of communication protocols/lighting command formats so as to control their respective light sources. In general, the processor 102 may be configured to respond to lighting commands in a variety of formats that express prescribed operating powers for each different channel of a multi-channel lighting unit according to some scale representing zero to maximum available operating power for each channel.

In one embodiment, the lighting unit 100 of FIG. 1 may include and/or be coupled to one or more power sources 108. In various aspects, examples of power source(s) 108 include, but are not limited to, AC power sources, DC power sources, batteries, solar-based power sources, thermoelectric or mechanical-based power sources and the like. Additionally, in one aspect, the power source(s) 108 may include or be associated with one or more power conversion devices that convert power received by an external power source to a form suitable for operation of the lighting unit 100.

While not shown explicitly in FIG. 1, the lighting unit 100 may be implemented in any one of several different structural configurations according to various embodiments of the present disclosure. Examples of such configurations include, but are not limited to, an essentially linear or curvilinear configuration, a circular configuration, an oval configuration, a rectangular configuration, combinations of the foregoing, various other geometrically shaped configurations, various two or three dimensional configurations, and the like.

A given lighting unit also may have any one of a variety of mounting arrangements for the light source(s), enclosure/housing arrangements and shapes to partially or fully enclose the light sources, and/or electrical and mechanical connection configurations. In particular, a lighting unit may be configured as a replacement or "retrofit" to engage electrically and mechanically in a conventional socket or fixture arrangement (e.g., an Edison-type screw socket, a halogen fixture arrangement, a fluorescent fixture arrangement, etc.).

Additionally, one or more optical elements as discussed above may be partially or fully integrated with an enclosure/housing arrangement for the lighting unit. Furthermore, a given lighting unit optionally may be associated with (e.g., include, be coupled to and/or packaged together with) various other components (e.g., control circuitry such as the processor and/or memory, one or more sensors/transducers/signal sources, user interfaces, displays, power sources, power conversion devices, etc.) relating to the operation of the light source(s).

Figure 2:
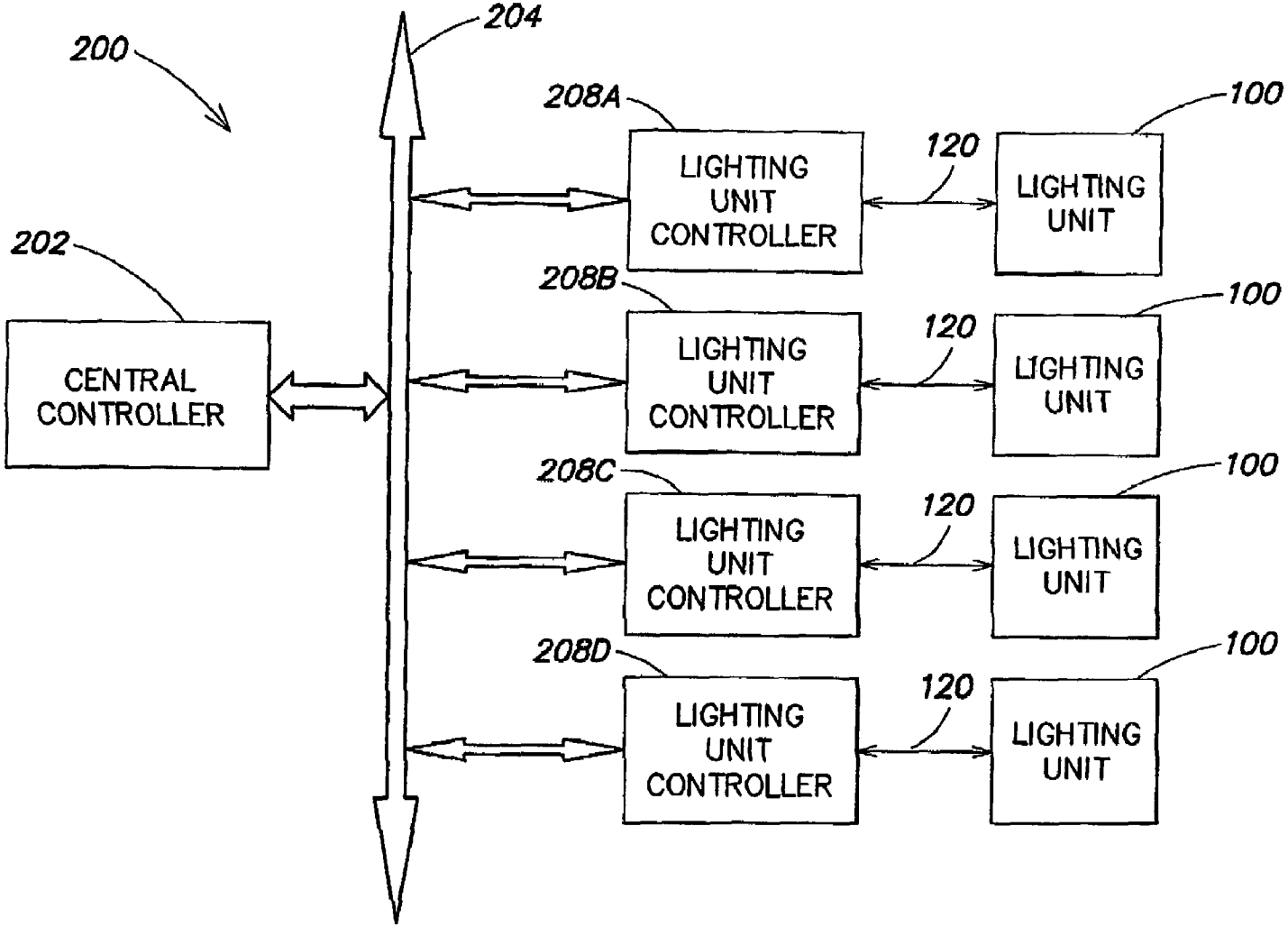
FIG. 2 is a diagram illustrating a networked lighting system according to one embodiment of the disclosure.

FIG. 2 illustrates an example of a networked lighting system 200 according to one embodiment of the present disclosure. In the embodiment of FIG. 2, a number of lighting units 100, similar to those discussed above in connection with FIG. 1, are coupled together to form the networked lighting system. It should be appreciated, however, that the particular configuration and arrangement of lighting units shown in FIG. 2 is for purposes of illustration only, and that the disclosure is not limited to the particular system topology shown in FIG. 2.

Additionally, while not shown explicitly in FIG. 2, it should be appreciated that the networked lighting system 200 may be configured flexibly to include one or more user interfaces, as well as one or more signal sources such as sensors/transducers. For example, one or more user interfaces and/or one or more signal sources such as sensors/transducers (as discussed above in connection with FIG. 1) may be associated with any one or more of the lighting units of the networked lighting system 200. Alternatively (or in addition to the foregoing), one or more user interfaces and/or one or more signal sources may be implemented as "stand alone" components in the networked lighting system 200. Whether stand alone components or particularly associated with one or more lighting units 100, these devices may be "shared" by the lighting units of the networked lighting system. Stated differently, one or more user interfaces and/or one or more signal sources such as sensors/transducers may constitute "shared resources" in the networked lighting system that may be used in connection with controlling any one or more of the lighting units of the system.

As shown in the embodiment of FIG. 2, the lighting system 200 may include one or more lighting unit controllers (hereinafter "LUCs") 208A, 208B, 208C, and 208D, wherein each LUC is responsible for communicating with and generally controlling one or more lighting units 100 coupled to it. Although FIG. 2 illustrates one lighting unit 100 coupled to each LUC, it should be appreciated that the disclosure is not limited in this respect, as different numbers of lighting units 100 may be coupled to a given LUC in a variety of different configurations (serially connections, parallel connections, combinations of serial and parallel connections, etc.) using a variety of different communication media and protocols.

In the system of FIG. 2, each LUC in turn may be coupled to a central controller 202 that is configured to communicate with one or more LUCs. Although FIG. 2 shows four LUCs coupled to the central controller 202 via a generic connection 204 (which may include any number of a variety of conventional coupling, switching and/or networking devices), it should be appreciated that according to various embodiments, different numbers of LUCs may be coupled to the central controller 202. Additionally, according to various embodiments of the present disclosure, the LUCs and the central controller may be coupled together in a variety of configurations using a variety of different communication media and protocols to form the networked lighting system 200. Moreover, it should be appreciated that the interconnection of LUCs and the central controller, and the interconnection of lighting units to respective LUCs, may be accomplished in different manners (e.g., using different configurations, communication media, and protocols).

For example, according to one embodiment of the present disclosure, the central controller 202 shown in FIG. 2 may by configured to implement Ethernet-based communications with the LUCs, and in turn the LUCs may be configured to implement DMX-based communications with the lighting units 100. In particular, in one aspect of this embodiment, each LUC may be configured as an addressable Ethernet-based controller and accordingly may be identifiable to the central controller 202 via a particular unique address (or a unique group of addresses) using an Ethernet-based protocol. In this manner, the central controller 202 may be configured to support Ethernet communications throughout the network of coupled LUCs, and each LUC may respond to those communications intended for it. In turn, each LUC may communicate lighting control information to one or more lighting units coupled to it, for example, via a DMX protocol, based on the Ethernet communications with the central controller 202.

More specifically, according to one embodiment, the LUCs 208A, 208B, and 208C shown in FIG. 2 may be configured to be "intelligent" in that the central controller 202 may be configured to communicate higher level commands to the LUCs that need to be interpreted by the LUCs before lighting control information can be forwarded to the lighting units 100. For example, a lighting system operator may want to generate a color changing effect that varies colors from lighting unit to lighting unit in such a way as to generate the appearance of a propagating rainbow of colors ("rainbow chase"), given a particular placement of lighting units with respect to one another. In this example, the operator may provide a simple instruction to the central controller 202 to accomplish this, and in turn the central controller may communicate to one or more LUCs using an Ethernet-based protocol high level command to generate a "rainbow chase." The command may contain timing, intensity, hue, saturation or other relevant information, for example. When a given LUC receives such a command, it may then interpret the command and communicate further commands to one or more lighting units using a DMX protocol, in response to which the respective sources of the lighting units are controlled via any of a variety of signaling techniques (e.g., PWM).

It should again be appreciated that the foregoing example of using multiple different communication implementations (e.g., Ethernet/DMX) in a lighting system according to one embodiment of the present disclosure is for purposes of illustration only, and that the disclosure is not limited to this particular example.

From the foregoing, it may be appreciated that one or more multi-channel lighting units as discussed above are capable of generating highly controllable variable color light over a wide range of colors, as well as variable color temperature white light over a wide range of color temperatures.

As discussed above, lighting units according to the present disclosure may have a variety of configurations and designs. In some cases, the general structure of a lighting unit, and in particular the configuration of a lighting unit housing, determines a maximum power handling capability of the lighting unit. This maximum power handling capability relates primarily to a heat dissipation capability of the lighting unit, or a maximum thermal power capacity which is not to be exceeded. In some conventional designs of multi-channel lighting units, it is often customary to divide the maximum power handling capability of the lighting unit by the number of lighting channels in the lighting unit to arrive at a maximum power per channel. In this manner, if a desired light output requires maximum contribution (i.e., 100%) from all of the different channels, damage to the lighting unit due to excessive thermal power generation may be avoided.

While the foregoing technique for specifying a maximum per channel power in a multi-channel lighting unit effectively mitigates damage to a lighting unit due to excessive thermal power generation, it nonetheless sacrifices some of the light-generating capability of the lighting unit. In particular, this problem is exacerbated for situations in which, to generate a desired color and brightness of light from the lighting unit, a prescribed percent operating power for one channel is significantly higher than that of another channel. For example, with reference again to Table 1, the lighting command indicated in the first row of Table 1 is specifying a full operating power for a first channel of a two-channel lighting unit and no output for the second channel to generate a desired color and brightness of light; however, the total operating power of the lighting unit in response to this command represents only half of the maximum power handling capability of the lighting unit (i.e., half of the total light-generating capability of the lighting unit—see the third row of Table 1).

In view of the foregoing, one embodiment of the present disclosure is directed to an improved power allocation method that exploits the total light-generating capability of a lighting unit while maintaining safe operating conditions, so as to avoid damage due to excessive thermal power generation.

In particular, in one embodiment, a power allocation method ensures that a lighting unit operates at or near its maximum power handling capability for a variety of possible high brightness lighting conditions by ascribing a maximum per channel operating power equal to the maximum power handling capability of the lighting unit. The power allocation method then reapportions, if necessary, prescribed percent operating powers for multiple channels, in response to a given lighting command, such that the ratio of the prescribed powers remains the same but the sum of the channel operating powers does not exceed the maximum power handling capability of the lighting unit.

Figure 3:
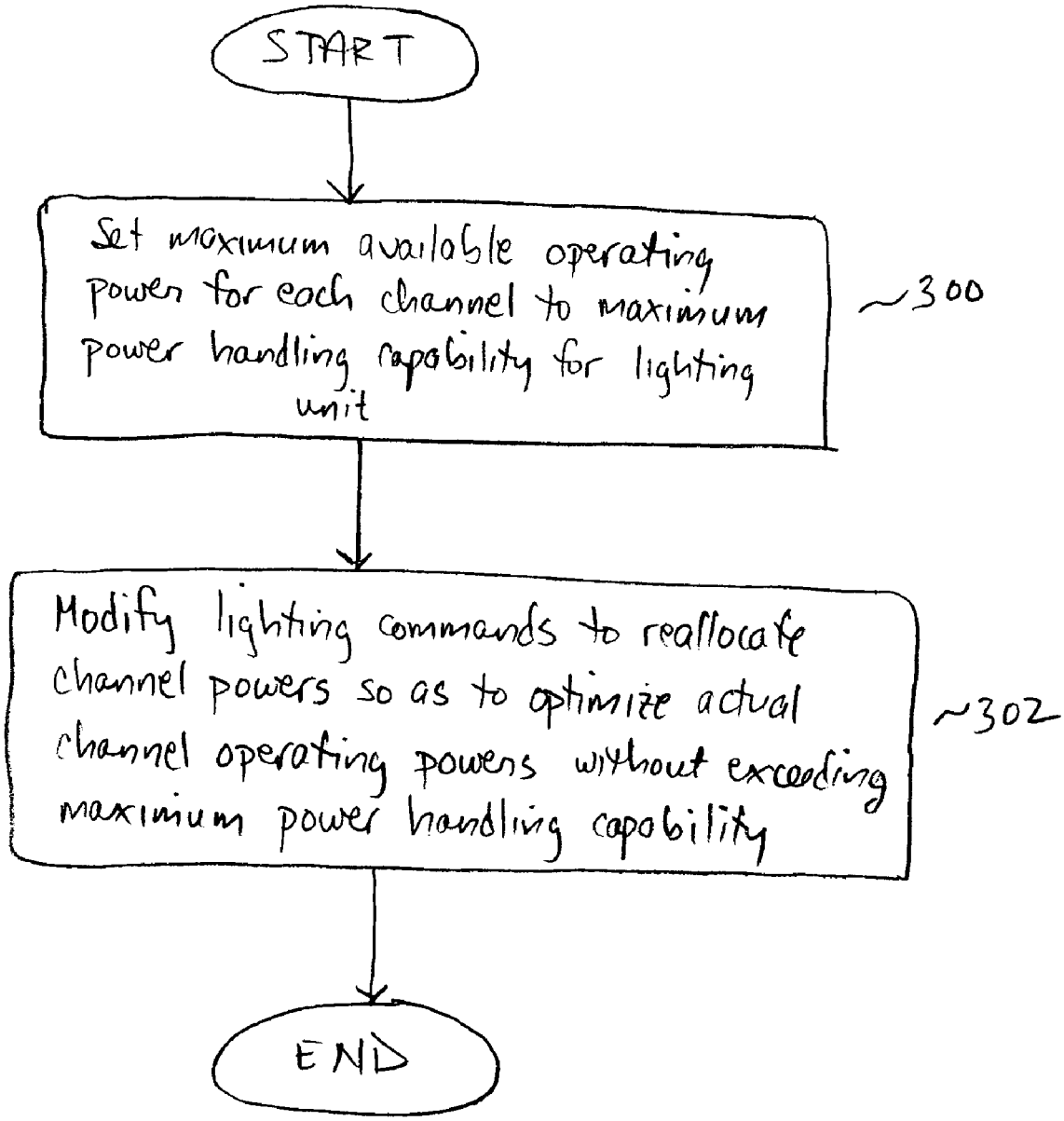
FIG. 3 is a flow diagram outlining a power allocation method according to one embodiment of the disclosure.

FIG. 3 is a flow diagram outlining a power allocation method according to one embodiment of the present disclosure. Rather than ascribing a maximum available operating power per channel by merely dividing the maximum power handling capability of the lighting unit by the number of channels, in block 300 of FIG. 3 the power allocation method sets the maximum available operating power for each channel to the maximum power handling capability for the lighting unit. With reference again to Eq. (1) above for purposes of comparison, the operating power $P_x$ of a given channel, in response to an arbitrary channel command $C_x$ (representing 0 to 100% of available channel power), is then given as $$P_x = C_x(P_{max}), \tag{2}$$

where $P_{max}$ denotes the maximum power handling capability of the lighting unit.

As indicated in block 302 of FIG. 3, the power allocation method according to this embodiment modifies incoming lighting commands to the lighting unit to reallocate prescribed channel operating powers so as to optimize actual channel operating powers without exceeding the maximum power handling capability of the lighting unit. To this end, the power allocation method maps an arbitrary incoming channel command $C_{x,in}$ (e.g., representing a prescribed percent operating power for the channel) to a modified command $C_x$, and the modified command $C_x$ then determines the actual channel operating power $P_x$ according to Eq. (2) above.

To illustrate a lighting command mapping according to one embodiment of the present disclosure, an exemplary two-channel lighting unit is considered, in which incoming commands for respective channels may be indicated as $[C_{1,in}, C_{2,in}]$. It should be appreciated, however, that the power allocation concepts discussed below theoretically are extensible to lighting units having any number of channels greater than two, as discussed further below.

In one embodiment, a mapping to modify lighting commands, according to block 302 of FIG. 3, may be implemented by the following relationships:

$$C_1 = \frac{[\max(C_{1,in}, C_{2,in}) \cdot C_{1,in}]}{C_{1,in} + C_{2,in}} \qquad C_2 = \frac{[\max(C_{1,in}, C_{2,in}) \cdot C_{2,in}]}{C_{1,in} + C_{2,in}} \tag{3}$$

where $C_1$ and $C_2$ represent the modified channel commands that ultimately dictate the actual operating powers for the first and second channels, respectively. Essentially, the relationships given in Eqs. (3) above restrict the total modified prescribed output power represented by $(C_1+C_2)$ to be less than the prescribed power represented by $[\max(C_{1,in}, C_{2,in})]$. In one exemplary lighting unit incorporating the power allocation method outlined in FIG. 3, the processor 102 shown in FIG. 1 may be configured to implement the power allocation method by receiving incoming lighting commands $[C_{1,in}, C_{2,in}]$, performing the mapping of Eqs. (3) above to provide modified lighting commands $[C_1, C_2]$, and then processing the modified commands to send appropriate control signals (e.g., PWM signals) to the light sources of the lighting unit so as to provide actual channel operating powers according to Eq. (2) above.

Table 2 below compares actual channel operating powers, based on Eq. (2) and Eqs. (3) above, with those originally indicated in Table 1 above (representing a conventional power division technique), for some exemplary lighting commands received by a two-channel lighting unit. As in the example of Table 1, a lighting unit having a maximum power handling capability of 100 Watts is considered for purposes of illustration.

TABLE 2

| $C_{1,in}$ command | $C_{2,in}$ command | $C_1$ power (Table 1) | $C_2$ power (Table 1) | Total Operating Power (Table 1) | $C_1$ actual power, Eq. (2) & Eqs. (3) | $C_2$ actual power, Eq. (2) & Eqs. (3) | Total Operating Power, Eq. (2) & Eqs. (3) |
|---|---|---|---|---|---|---|---|
| 100% | 0% | 50 W | 0 W | 50 W | 100 W | 0 W | 100 W |
| 100% | 50% | 50 W | 25 W | 75 W | 67 W | 33 W | 100 W |

TABLE 2-continued

| $C_{1,in}$ command | $C_{2,in}$ command | $C_1$ power (Table 1) | $C_2$ power (Table 1) | Total Operating Power (Table 1) | $C_1$ actual power, Eq. (2) & Eqs. (3) | $C_2$ actual power, Eq. (2) & Eqs. (3) | Total Operating Power, Eq. (2) & Eqs. (3) |
|---|---|---|---|---|---|---|---|
| 100% | 100% | 50 W | 50 W | 100 W | 50 W | 50 W | 100 W |
| 50% | 100% | 25 W | 50 W | 75 W | 33 W | 67 W | 100 W |
| 0% | 100% | 0 W | 50 W | 50 W | 0 W | 100 W | 100 W |
| 50% | 50% | 25 W | 25 W | 50 W | 25 W | 25 W | 50 W |
| 25% | 25% | 12.5 W | 12.5 W | 25 W | 12.5 W | 12.5 W | 25 W |

Although the channel commands $C_1$ and $C_2$ are indicated in Table 2 in terms of percent available operating power for the channel (so as to provide a direct comparison with Table 1), it should be appreciated that lighting commands may express values for individual channel commands using any of a variety of formats (e.g., using 8-bit data, wherein each channel command has a value from 0 to 255). From Table 2, it is readily apparent that for lighting commands prescribing a relatively significant channel operating power (e.g., greater than 50%) for one or more channels, the power allocation method according to Eqs. (3) optimizes the actual channel operating powers to effectively increase light output, while at the same time maintaining the prescribed ratio of channel operating powers and overall safe operating conditions at or below the maximum power handling capability of the lighting unit (compare rows 1-5 in columns 5 and 8 of Table 2). In particular, for the two-channel lighting unit exemplified above implementing the power allocation method of Eqs. (3), essentially twice the light output is provided when the lighting unit is operated near full power for either channel, as compared to a lighting unit employing the power division technique discussed above in connection with Table 1.

In various embodiments, Eqs. (3) may be implemented directly (e.g., based on a program executed by the processor 102 of a lighting unit) or may be reasonably approximated based on available computational resources. For example, in one embodiment, a piecewise linear approximation for Eqs. (3) may be implemented by a processor 102 having a limited amount of memory and processing capability (e.g., such a processor may be employed for space-saving and/or cost-saving reasons). In this embodiment, a piecewise linear approximation first compares the values of the two individual channel commands of an incoming lighting command to determine the minimum value (Min_In) and the maximum value (Max_In), and assigns four possible ranges for the minimum value according to:

$$1)\ 0<\text{Min_In}<\tfrac{1}{4}(\text{Max_In})$$

$$2)\ \tfrac{1}{4}(\text{Max_In})<\text{Min_In}<\tfrac{1}{2}(\text{Max_In})$$

$$3)\ \tfrac{1}{2}(\text{Max_In})<\text{Min_In}<\tfrac{3}{4}(\text{Max_In})$$

$$4)\ \tfrac{3}{4}(\text{Max_In})<\text{Min_In}<\text{Max_In}.$$

Based on the range in which the Min_In value falls, a corresponding modified channel command for the channel with the minimum value, i.e., Min_Out, is derived as follows:

$$1)\ \text{Min_Out}=(\tfrac{4}{3})\text{Min_In}$$

$$2)\ \text{Min_Out}=(\tfrac{1}{3})\text{Max_In}+(\tfrac{8}{15})(\text{Min_In}-(\tfrac{1}{4})\text{Max_In})$$

$$3)\ \text{Min_Out}=(\tfrac{1}{3})\text{Max_In}+(\tfrac{8}{21})(\text{Min_In}-(\tfrac{1}{2})\text{Max_In})$$

$$4)\ \text{Min_Out}=(\tfrac{3}{7})\text{Max_In}+(\tfrac{2}{7})(\text{Min_In}-(\tfrac{3}{4})\text{Max_In})$$

A modified channel command for the channel with the maximum value, i.e., Max_Out, is then determined according to:

$$\text{Max_Out}=\text{Max_In}-\text{Min_Out}.$$

One issue that may arise in connection with controlling power to one or more light sources of a lighting unit relates to a non-linear relationship between the operating power of a given light source and a corresponding perceived brightness of the light generated by the light source. Such a non-linear relationship between operating power and perceived brightness is discussed in detail in U.S. Pat. No. 6,975,079, issued Dec. 13, 2005, entitled "Systems and Methods for Controlling Illumination Sources," hereby incorporated herein by reference. For example, the perceived brightness of generated light typically changes more dramatically with changes in radiant output power at relatively low power levels, whereas changes in radiant output power at relatively higher power levels typically result in a somewhat less pronounced change in perceived brightness. Accordingly, depending on the resolution of incoming lighting commands, changes in power at relatively low radiant output power levels in some cases may cause perceived "flicker" (e.g., perceived abrupt changes) in the brightness of generated light.

In view of the foregoing, according to one embodiment of the present disclosure, incoming lighting commands may be modified so as to compensate at least in part for such a non-linear relationship between changes in operating power and corresponding changes in perceived brightness. In various aspects of this embodiment, one or more of the individual channel commands of an incoming lighting command may be modified according to some non-linear mapping (e.g., an exponential function having a lower slope for relatively lower powers and a higher slope for relatively higher powers), and then subsequently modified again to implement any of the power allocation techniques disclosed herein.

To implement non-linear compensation, according to one embodiment lighting commands may be modified to provide for an overall higher resolution in prescribed channel powers, which then may be exploited particularly at relatively lower operating powers to compensate for a more acute perception of brightness changes with power changes at lower power levels. For example, consider incoming lighting commands wherein each individual channel command is coded as an 8-bit data word, such that the operating power of any given channel may be specified in $2^8=256$ increments from 0 to 255 (corresponding to 0 to 100%). According to one embodiment, incoming commands are mapped to a data format that employs a greater number of data bits per channel. For example, for an incoming lighting command in an 8-bit per channel format, commands may be mapped to a format using greater than 8-bits per channel (e.g., 10, 12, 14, 16, etc). By mapping to a data format employing a greater number of bits, greater resolution may be realized.

To demonstrate this concept, an exemplary mapping from an 8-bit format to a 14-bit format is considered. In the 8-bit format, as noted above, the resolution of operating power control from zero to full channel power is given in 256 increments, whereas in the 14-bit format, the resolution of operating power control is given in $2^{14}$=16,384 increments. In a "direct" or linear mapping from 8-bit data to 14-bit data, incoming channel data in 8-bit format is "shifted" to occupy the higher-order eight bits of a 14-bit data word (i.e., the incoming 8-bit data for a channel may be "left-shifted" by six bits). This implies that a value of "1" on a scale of 0 to 255 in an 8-bit data format would be mapped to a minimum non-zero value of "64" on a scale of 0 to 16,383 in the 14-bit data format; stated differently, a direct (linear) mapping from 8-bits to some higher number of bits implies some "offset" for the minimum non-zero value.

Rather than a direct or linear mapping, however, a non-linear transformation may be implemented in mapping incoming 8-bit data to 14-bit data. In particular, the non-linear transformation may exploit the higher resolution of the 14-bit data to provide a data word which exhibits a "finer" degree of control particularly in the relatively lower power ranges. In essence, rather than "directly" mapping from 8-bit to 14-bit data (left-shifting by six bits), intervening values of the 14-bit data may be used. For example, as discussed above, a value of "1" in 8-bit data is mapped directly (i.e., linearly) to a value of "64" in 14-bit data, but alternatively may be mapped to any value between 0 and 64 pursuant to some non-linear relationship (e.g., an exponential function). Similarly, a value of "2" in 8-bit data is mapped directly (linearly) to a value of "128" in 14-bit data, but alternatively may be mapped to any value between 65 and 128 pursuant to some non-linear relationship. Accordingly, significantly enhanced resolution is provided that may be exploited especially for lower powers to compensate for non-linear behavior in brightness perception.

Figure 4:
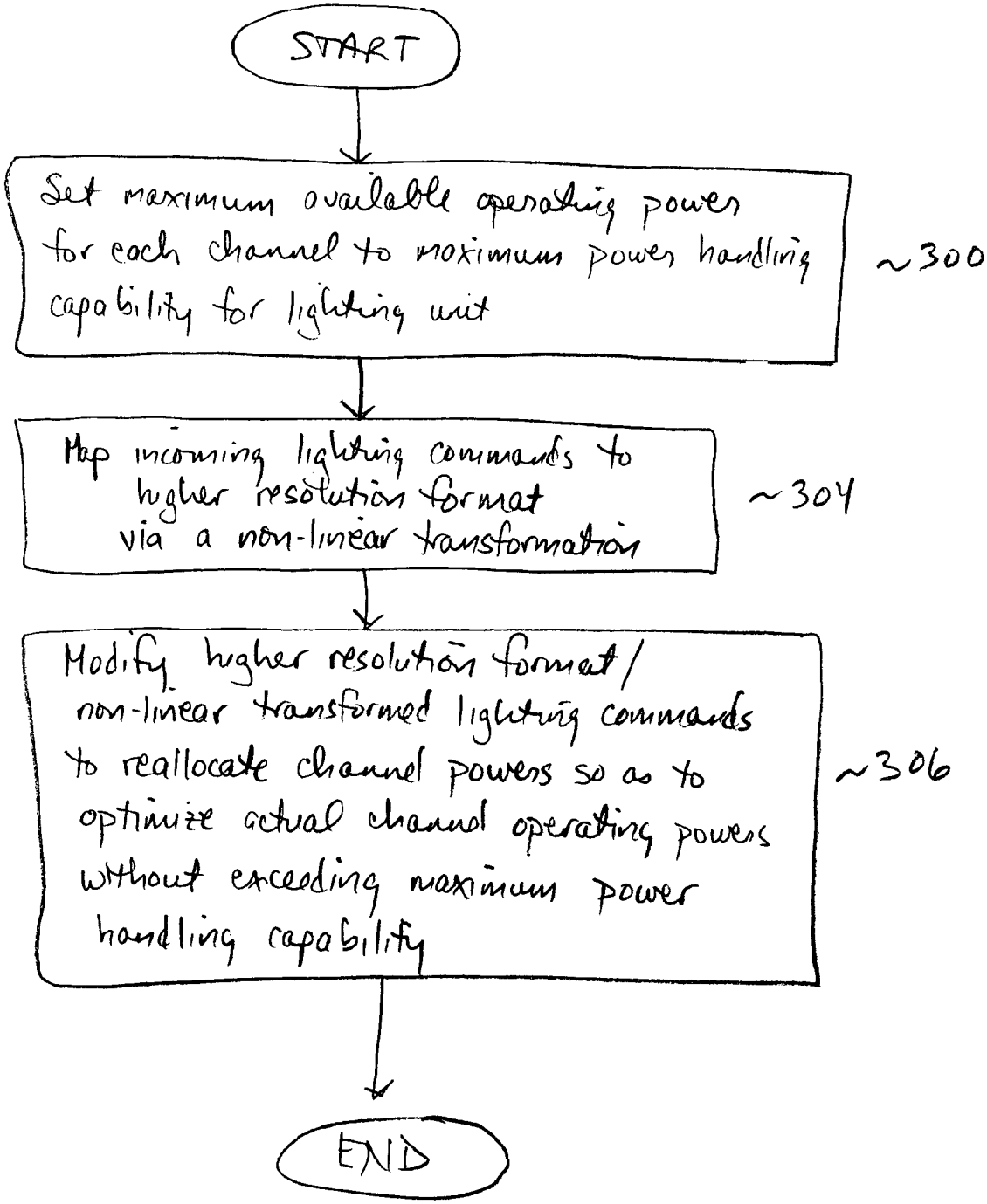
FIG. 4 is a flow diagram illustrating how non-linear compensation may be used together with power allocation methods, according to one embodiment of the disclosure.

FIG. 4 is a flow diagram illustrating how non-linear compensation may be used together with power allocation methods disclosed herein. Because non-linear compensation may involve an exponential transformation in channel command values, according to one embodiment non-linear compensation is performed prior to a reallocation of power amongst the channels so as to avoid an inadvertent reduction in radiant output power rather than an optimization of channel powers for a given lighting command.

In block 300 of FIG. 4, as in FIG. 3, again a maximum available operating power for each channel is set equal to the maximum power handling capability for the lighting unit. In block 304 of FIG. 4, incoming lighting commands are mapped to a higher resolution format (e.g., from 8-bit data to 14-bit data) via a non-linear transformation. The non-linear correspondence between lower resolution data words and higher resolution data words may be implemented via a look-up table (e.g., stored in the memory 114 of the lighting unit) that defines the transformation, or a program executed by the processor 102 to derive the value of the higher resolution data word based on some function of the value of the lower resolution data word (e.g., an exponential function or other function). In block 306 of FIG. 4, the higher resolution format/non-linear transformed lighting commands are then modified to reallocate the channel powers so as to optimize actual channel operating powers without exceeding the maximum power handling capability of the lighting unit.

By performing the non-linear transformation before the reallocation of channel powers, appropriate optimization of channel operating powers is realized; otherwise, inadvertently low output power may result from the reverse process. For example, consider a two-channel lighting unit receiving an incoming command in an 8-bit format $[C_{1,in}, C_{2,in}]$=[255, 255], i.e., 100% for each channel. From Table 2, the operating power of each channel in response to such an incoming command is expected to be 50% of the maximum power handling capability (i.e., 50 Watts for each channel based on a maximum power handling capability of 100 Watts). If power allocation were performed on the incoming command in 8-bit format pursuant to Eqs. (3), the modified 8-bit lighting command would be $[C_1, C_2]$=[127, 127]; i.e., the power allocation according to Eqs. (3) has scaled down the 8-bit channel commands, as expected.

If these scaled down channel commands are then mapped to a higher resolution format via a non-linear transformation, the resulting non-linear transformed higher resolution lighting commands will have lower values than if the original 8-bit commands $[C_{1,in}, C_{2,in}]$=[255, 255] were used for the non-linear transformation (a situation which is especially exacerbated by virtue of an exponential non-linear transformation). Conversely, if the original 8-bit commands $[C_{1,in}, C_{2,in},]$=[255, 255] are first mapped to a higher resolution format via a non-linear transformation, and then modified lighting commands are derived from the higher resolution commands according to Eqs. (3), an appropriate channel power optimization results.

In one embodiment, a two-channel lighting unit according to the present disclosure, configured to implement any of the power allocation methods outlined herein (including those also configured for non-linear compensation), may comprise a first light source including one or more white LEDs generating essentially white light having a first spectrum, and a second light source including one or more white LEDs generating essentially white light having a second spectrum different than the first spectrum. For example, in one aspect of this embodiment, the first light source may include one or more "warm" white LEDs that generate spectrums corresponding to color temperatures in a range of approximately 2900-3300 degrees K (a first "warm" spectrum, or "warm channel"), and the second light source may include one or more "cool" white LEDs that generate spectrums corresponding to color temperatures in a range of approximately 6300-7000 degrees K (a second "cool" spectrum, or "cool channel"). By mixing different proportions of the warm and cool spectrums, a wide variety of intermediate color temperatures of white light may be generated. By implementing a power allocation method as described herein, such white light-generating lighting units have an effectively increased light output for relatively higher brightness conditions (significant channel operating powers), especially when the unit is operated near or at full power for either the warm channel or the cool channel.

Figure 5:
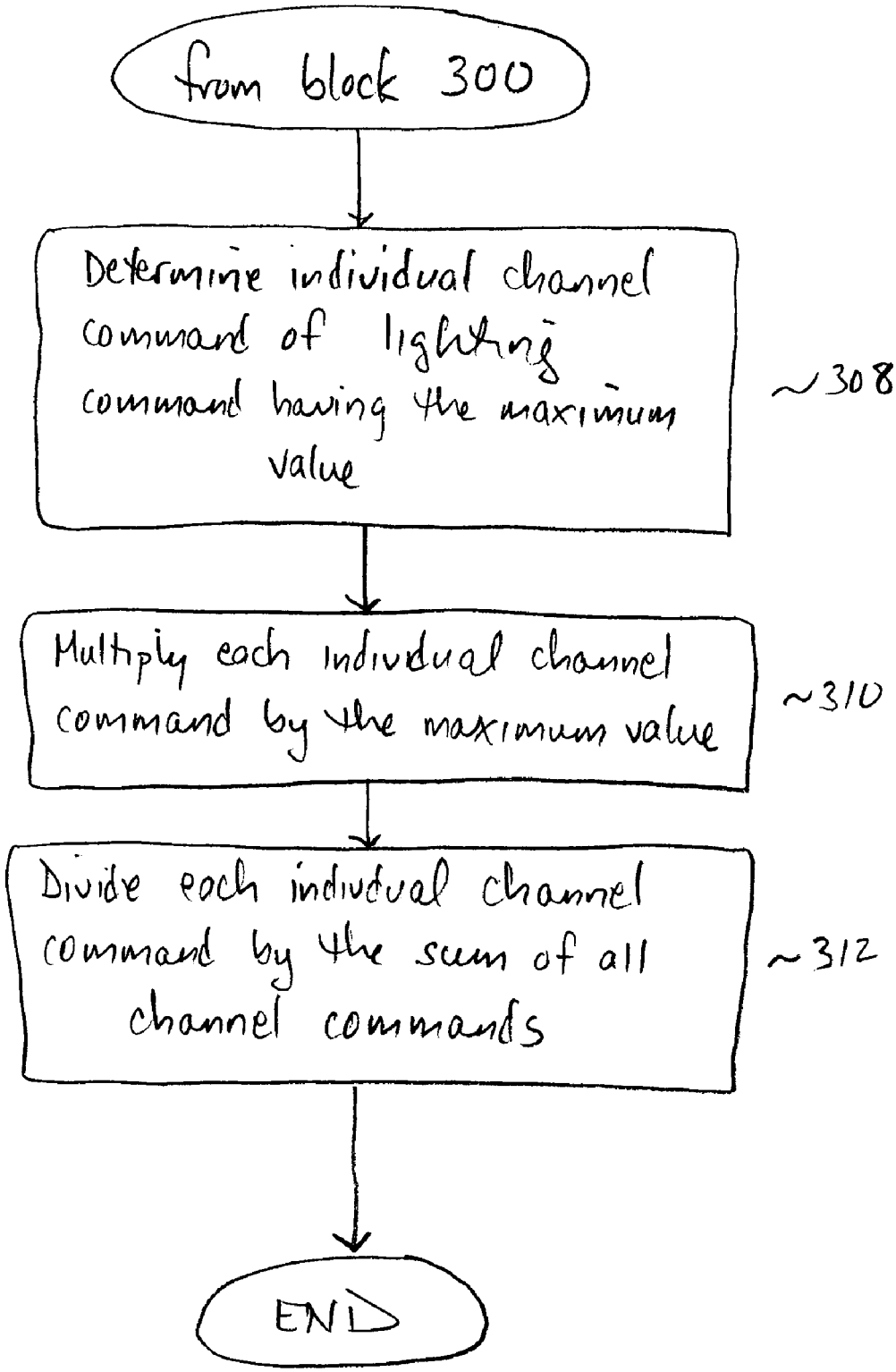
FIG. 5 is a flow diagram outlining further details of a power allocation method according to one embodiment of the disclosure that applies generally to lighting units having any number of channels.

More generally, it should be appreciated that the power allocation concepts disclosed herein in connection with exemplary two-channel lighting units may be applied similarly to lighting units having three or more channels (wherein each channel may represent any of a variety of spectrums corresponding to different non-white colors of light, and/or different color temperatures of white light). For example, according to one embodiment, with reference again to Eqs. (3) above and FIG. 5, each channel command of an incoming lighting command for a multi-channel lighting unit (or channel commands that have already been mapped via a non-linear transformation) may be modified by first determining the individual channel command of the incoming lighting command having the maximum value (FIG. 5, block 308), multiplying each individual channel command by this maximum value (FIG. 5, block 310), and dividing each individual channel command by the sum of all of the channel commands (FIG. 5, block 312). In this manner, regardless of the actual format used to express the values of the individual channel commands (e.g., percentage of available operating power from 0 to 100%, 8-bit values from 0 to 255, 14-bit values from 0 to 16,383, etc.), a power allocation method may be implemented for lighting units having virtually any number of different channels.

Having thus described several illustrative embodiments, it is to be appreciated that various alterations, modifications, and improvements will readily occur to those skilled in the art. Such alterations, modifications, and improvements are intended to be part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments. Accordingly, the foregoing description and attached drawings are by way of example only, and are not intended to be limiting.

The invention claimed is:

1. In an apparatus comprising at least one first light source to generate first radiation having a first spectrum, at least one second light source to generate second radiation having a second spectrum different from the first spectrum, at least one controller configured to allocate operating power for the at least one first light source and the at least one second light source, and at least one structure coupled to the at least one first light source and the at least one second light source, the at least one structure having a maximum power handling capability, a method comprising acts of:

A) storing in at least one memory a maximum available operating power for the at least one first light source equal to the maximum power handling capability of the at least one structure and a maximum available operating power for the at least one second light source equal to the maximum power handling capability of the at least one structure;

B) receiving by the controller at least one lighting command including at least a first channel command representing a prescribed first operating power for the at least one first light source and a second channel command representing a prescribed second operating power for the at least one second light source;

C) modifying by the controller the at least one lighting command, if necessary, to optimize the first and second operating powers without exceeding the maximum power handling capability of the at least one structure, wherein the act of modifying the at least one lighting command comprises:

determining one of at least the first channel command and the second channel command having a maximum value;

multiplying each of at least the first channel command and the second channel command by the maximum value; and dividing each of at least the first channel command and the second channel command by a sum of at least the first channel command and the second channel command.

2. The method of claim 1, wherein before the act C), the method includes an act of:

B1) applying a non-linear transformation to at least the first channel command and the second channel command to provide at least a non-linear transformed first channel command and a non-linear transformed second channel command.

3. The method of claim 2, wherein the act B1) comprises an act of:

mapping the received at least one lighting command to a higher resolution format for at least the non-linear transformed first channel command and the non-linear transformed second channel command.

4. The method of claim 3, wherein each of the first channel command and the second channel command is coded as an 8-bit data word, and wherein each of the non-linear transformed first channel command and the non-linear transformed second channel command is coded as a 14-bit data word.

5. The method of claim 2, wherein:

the determining act further comprises determining one of at least the non-linear transformed first channel command and the non-linear transformed second channel command having a maximum value;

the multiplying act further comprises multiplying each of at least the non-linear transformed first channel command and the non-linear transformed second channel command by the maximum value; and the dividing act further comprises dividing each of at least the non-linear transformed first channel command and the non-linear transformed second channel command by a sum of at least the non-linear transformed first channel command and the non-linear transformed second channel command.

6. In an apparatus comprising at least one first light source to generate first radiation having a first spectrum, at least one second light source to generate second radiation having a second spectrum different from the first spectrum, at least one controller configured to allocate operating power for the at least one first light source and the at least one second light source, and at least one structure coupled to the at least one first light source and the at least one second light source, the at least one structure having a maximum power handling capability, a method comprising:

A) receiving by the controller at least one lighting command including at least a first channel command representing a prescribed first operating power for the at least one first light source and a second channel command representing a prescribed second operating power for the at least one second light source; and B) allocating by the controller a first operating power for the at least one first light source and a second operating power for the at least one second light source based on the at least one lighting command so as to optimize the first and second operating powers without exceeding the maximum power handling capability of the at least one structure.

7. The method of claim 6, wherein the apparatus further comprises at least one third light source to generate third radiation having a third spectrum different from the first spectrum and the second spectrum, wherein the at least one structure is coupled to the at least one first light source, the at least one second light source, and the at least one third light source, and wherein the allocating step further comprises:

allocating the first operating power, the second operating power, and a third operating power for the at least one third light source so as to optimize the first, second, and third operating powers without exceeding the maximum power handling capability of the at least one structure.

8. The method of claim 6, further comprising:

modifying at least one of the first channel command and the second channel command, if necessary, to allocate the first operating power and the second operating power.

9. The method of claim 8, further comprising:

storing in at least one memory a maximum available operating power for each of the at least one first light source and the at least one second light source equal to the maximum power handling capability of the at least one structure; and wherein modifying comprises acts of:

determining one of at least the first channel command and the second channel command having a maximum value;

multiplying each of at least the first channel command and the second channel command by the maximum value; and dividing each of at least the first channel command and the second channel command by a sum of at least the first channel command and the second channel command.

10. The method of claim 6, further comprising:

applying a non-linear transformation to at least the first channel command and the second channel command to provide at least a non-linear transformed first channel command and a non-linear transformed second channel command.

11. The method of claim 10, wherein applying the non-linear transformation comprises an act of:

mapping the received at least one lighting command to a higher resolution format for at least the non-linear transformed first channel command and the non-linear transformed second channel command.

12. The method of claim 11, wherein each of the first channel command and the second channel command is coded as an 8-bit data word, and wherein each of the non-linear transformed first channel command and the non-linear transformed second channel command is coded as a 14-bit data word.

13. The method of claim 10, further comprising an act of:

modifying at least one of the non-linear transformed first channel command and the non-linear transformed second channel command, if necessary, to allocate the first operating power and the second operating power so as to optimize the first and second operating powers without exceeding the maximum power handling capability.

14. The method of claim 13, further comprising:

storing in at least one memory a maximum available operating power for each of the at least one first light source and the at least one second light source equal to the maximum power handling capability of the at least one structure; and wherein the act of modifying comprises acts of:

determining one of at least the non-linear transformed first channel command and the non-linear transformed second channel command having a maximum value;

multiplying each of at least the non-linear transformed first channel command and the non-linear transformed second channel command by the maximum value; and dividing each of at least the non-linear transformed first channel command and the non-linear transformed second channel command by a sum of at least the non-linear transformed first channel command and the non-linear transformed second channel command.

15. An apparatus, comprising:

at least one first light source to generate first radiation having a first spectrum;

at least one second light source to generate second radiation having a second spectrum different from the first spectrum;

at least one structure coupled to the at least one first light source and the at least one second light source, the at least one structure having a maximum power handling capability; and at least one controller configured to allocate a first operating power for the at least one first light source and a second operating power for the at least one second light source so as to optimize the first and second operating powers without exceeding the maximum power handling capability, wherein the at least one controller is configured to receive at least one lighting command including at least a first channel command representing a prescribed first operating power for the at least one first light source and a second channel command representing a prescribed second operating power for the at least one second light source, and wherein the at least one controller further is configured to modify at least one of the first channel command and the second channel command, if necessary, to allocate the first operating power and the second operating power.

16. The apparatus of claim 15, wherein the apparatus is configured such that the maximum available operating power for each of the at least one first light source and the at least one second light source is equal to the maximum power handling capability, and wherein the at least one controller further is configured to:

determine one of at least the first channel command and the second channel command having a maximum value;

multiply each of at least the first channel command and the second channel command by the maximum value; and divide each of at least the first channel command and the second channel command by a sum of at least the first channel command and the second channel command.

17. The apparatus of claim 16, wherein the at least one first light source includes at least one first white LED.

18. The apparatus of claim 17, wherein the at least one second light source includes at least one second white LED.

19. The apparatus of claim 16, wherein at least one of the at least one first light source and the at least one second light source includes at least one non-white LED.

20. An apparatus, comprising:

at least one first light source to generate first radiation having a first spectrum;

at least one second light source to generate second radiation having a second spectrum different from the first spectrum;

at least one structure coupled to the at least one first light source and coupled to the at least one second light source, the at least one structure having a maximum power handling capability; and at least one controller configured to allocate a first operating power for the at least one first light source and a second operating power for the at least one second light source so as to optimize the first and second operating powers without exceeding the maximum power handling capability, wherein the at least one controller is configured to receive at least one lighting command including at least a first channel command representing a prescribed first operating power for the at least one first light source and a second channel command representing a prescribed second operating power for the at least one second light source, and wherein the at least one controller further is configured to apply a non-linear transformation to at least the first channel command and the second channel command to provide at least a non-linear transformed first channel command and a non-linear transformed second channel command.

21. The apparatus of claim 20, wherein the at least one controller is configured to map the received at least one lighting command to a higher resolution format in applying the non-linear transformation.

22. The apparatus of claim 21, wherein each of the first channel command and the second channel command is coded as an 8-bit data word, and wherein each of the non-linear transformed first channel command and the non-linear transformed second channel command is coded as a 14-bit data word.

23. The apparatus of claim 21, wherein the at least one controller is further configured to modify at least one of the non-linear transformed first channel command and the non-linear transformed second channel command, if necessary, to allocate the first operating power and the second operating power so as to optimize the first and second operating powers without exceeding the maximum power handling capability.

24. The apparatus of claim 23, wherein the apparatus is configured such that the maximum available operating power for each of the at least one first light source and the at least one second light source is equal to the maximum power handling capability, and wherein the at least one controller further is configured to:

determine one of at least the non-linear transformed first channel command and the non-linear transformed second channel command having a maximum value;

multiply each of at least the non-linear transformed first channel command and the non-linear transformed second channel command by the maximum value; and divide each of at least the non-linear transformed first channel command and the non-linear transformed second channel command by a sum of at least the non-linear transformed first channel command and the non-linear transformed second channel command.

25. The apparatus of claim 24, wherein the at least one first light source includes at least one first white LED.

26. The apparatus of claim 25, wherein the at least one second light source includes at least one second white LED.

27. The apparatus of claim 24, wherein at least one of the at least one first light source and the at least one second light source includes at least one non-white LED.

* * * * *